US006554722B2

(12) United States Patent
Erickson et al.

(10) Patent No.: US 6,554,722 B2
(45) **Date of Patent: *Apr. 29, 2003**

(54) GOLF CLUB HEAD

(75) Inventors: Joel B. Erickson, Carlsbad, CA (US); Roger Cleveland, Los Angeles, CA (US); Richard C. Helmstetter, Rancho Santa Fe, CA (US); Augustin W. Rollinson, Carlsbad, CA (US); Luke R. Williams, La Jolla, CA (US); M. Grace Hohn Pimentel, Oceanside, CA (US); Thomas J. DiMarco, Carlsbad, CA (US); John G. Guard, Oceanside, CA (US); James F. Dooley, Fallbrook, CA (US)

(73) Assignee: Callaway Golf Company, Carlsbad, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/683,816

(22) Filed: Feb. 19, 2002

(65) Prior Publication Data

US 2002/0115503 A1 Aug. 22, 2002

Related U.S. Application Data

(63) Continuation-in-part of application No. 09/752,398, filed on Dec. 29, 2000, now Pat. No. 6,379,263, which is a continuation of application No. 09/330,292, filed on Jun. 12, 1999, now Pat. No. 6,210,290.

(51) Int. Cl.[7] ..... A63B 53/04

(52) U.S. Cl. ..... 473/334; 473/334; 473/349; 473/341; 473/350

(58) Field of Search ..... 473/345, 347, 473/348, 350, 335, 334

(56) References Cited

U.S. PATENT DOCUMENTS

| | | | |
|---|---|---|---|
| 722,011 | A | 3/1903 | Govan |
| 1,333,129 | A | 3/1915 | Govan |
| 1,678,637 | A | 7/1928 | Drevitson |
| 1,968,627 | A | 7/1934 | Young |
| 2,360,364 | A | 10/1942 | Reach |
| 2,774,600 | A | 12/1956 | Reach |
| 2,846,228 | A | 8/1958 | Reach |
| 3,250,536 | A | 5/1966 | Moser |
| 3,847,399 | A | 11/1974 | Raymont |
| 3,961,796 | A | 6/1976 | Thompson |
| 3,995,865 | A | 12/1976 | Cochran et al. |
| 4,145,052 | A | 3/1979 | Janssen et al. |
| 4,326,326 | A | 4/1982 | MacDonald |
| 4,340,230 | A | 7/1982 | Churchward |
| 4,690,408 | A | 9/1987 | Kobayashi |
| 4,754,977 | A | 7/1988 | Sahm |
| 4,792,140 | A | 12/1988 | Yamaguchi et al. |
| 4,793,616 | A | 12/1988 | Fernandez |
| 4,826,172 | A | 5/1989 | Antonious |

(List continued on next page.)

FOREIGN PATENT DOCUMENTS

| | | |
|---|---|---|
| GB | 1387955 | 1/1976 |
| JP | 6 2097570 | 5/1987 |
| JP | 6 2097571 | 5/1987 |
| JP | 404341281 A | 11/1992 |
| JP | 406091021 A | 4/1994 |

*Primary Examiner*—Paul T. Sewell
*Assistant Examiner*—Thanh P Duong
(74) *Attorney, Agent, or Firm*—Michael A. Catania

(57) ABSTRACT

A golf club head having a defined internal cavity, and a golf club head containing a bi-material weight having a nonhomogeneous structure is disclosed herein. A method to add the bi-material weight to the golf club entails heating, vibration and cooling to produce the nonhomogeneous structure is also disclosed herein.

11 Claims, 9 Drawing Sheets

U.S. PATENT DOCUMENTS 4,836,550 A 6/1989 Kobayashi
4,852,880 A 8/1989 Kobayashi
4,941,666 A 7/1990 Suganuma
4,944,515 A 7/1990 Shearer
4,964,640 A 10/1990 Nakanishi et al.
4,964,641 A 10/1990 Miesch et al.
4,988,104 A 1/1991 Shiotani et al.
5,050,879 A 9/1991 Sun et al.
5,078,397 A 1/1992 Aizawa
5,080,366 A 1/1992 Okumoto et al.
5,104,457 A 4/1992 Viljoen et al.
5,120,062 A 6/1992 Scheie et al.
5,143,571 A 9/1992 Lacoste et al.
5,190,290 A 3/1993 Take
5,193,811 A 3/1993 Okumoto et al.
5,198,062 A 3/1993 Chen
5,221,087 A 6/1993 Fenton et al.
5,271,227 A 6/1993 Shira
5,228,694 A 7/1993 Okumoto et al.
5,261,478 A 11/1993 Sun
5,282,625 A 1/1994 Schmidt et al.
5,290,036 A 3/1994 Fenton et al.
5,312,106 A 5/1994 Cook
5,333,872 A 8/1994 Manning et al.
5,342,812 A 8/1994 Niskanen et al.
5,354,059 A 10/1994 Stuff
5,380,010 A 1/1995 Werner et al.
5,385,348 A 1/1995 Wargo
5,405,137 A 4/1995 Vincent et al.
5,421,577 A 6/1995 Kobayashi
5,425,535 A 6/1995 Gee
5,431,401 A 7/1995 Smith
5,435,551 A 7/1995 Chen
5,439,223 A 8/1995 Kobayashi
5,447,311 A 9/1995 Viollaz et al.
5,464,218 A 11/1995 Schmidt et al.
5,472,203 A 12/1995 Schmidt et al.
5,474,297 A 12/1995 Levin
5,482,279 A 1/1996 Antonious
5,489,098 A 2/1996 Gojny et al.
5,492,327 A 2/1996 Biafore, Jr.
5,494,281 A 2/1996 Chen
5,497,993 A 3/1996 Shan
5,509,659 A 4/1996 Igarashi
5,516,107 A 5/1996 Okumoto et al.
5,522,593 A 6/1996 Kobayashi et al.
5,564,705 A 10/1996 Kobayashi et al.
5,570,886 A 11/1996 Rigal et al.
5,588,923 A 12/1996 Schmidt et al.
5,590,881 A 1/1997 Jernigan
5,595,548 A 1/1997 Beck
5,601,501 A 2/1997 Kobayashi
5,603,668 A 2/1997 Antonious
5,611,742 A 3/1997 Kobayashi
5,626,530 A 3/1997 Schmidt et al.
5,643,111 A 7/1997 Igarashi
5,655,976 A 8/1997 Rife
5,658,208 A 8/1997 Shimasaki
5,665,013 A 9/1997 Kobayashi
5,669,826 A 9/1997 Chang et al.
5,674,133 A 10/1997 Change et al.
5,676,605 A 10/1997 Kobayashi
5,676,606 A 10/1997 Schaeffer et al.
5,681,227 A 10/1997 Sayrizi
5,704,850 A 1/1998 Shieh
5,749,794 A 5/1998 Kobayashi et al.
5,749,795 A 5/1998 Schmidt et al.
5,766,091 A 6/1998 Humphrey et al.
5,766,092 A 6/1998 Mimeur et al.
5,769,735 A 6/1998 Hosokawa
5,776,010 A 7/1998 Helmstetter et al.
5,971,868 A * 10/1999 Kosmatka ..... 473/349

* cited by examiner

| IRON | GRAMS | CUBIC CENTIMETERS | GRAMS |
|---|---|---|---|
| 1 | 127.7 | 10.4 | 224.5 |
| 2 | 127.6 | 10.9 | 229 |
| 3 | 127.5 | 11.5 | 235.3 |
| 4 | 128 | 12 | 241 |
| 5 | 128.1 | 12.6 | 246.5 |
| 6 | 128.6 | 13.3 | 255.3 |
| 7 | 129 | 13.9 | 261 |
| 8 | 135.8 | 13.9 | 268 |
| 9 | 138.7 | 14.2 | 275 |
| P | 148.4 | 14.6 | 285.8 |
| A | 153.6 | 14.1 | 286.5 |
| S | 166.4 | 13.3 | 290.5 |
| L | 156.3 | 14.2 | 290.5 |

GOLF CLUB HEAD

CROSS REFERENCE TO RELATED APPLICATIONS

This patent application is a continuation-in-part application of U.S. patent application Ser. No. 09/752,398, filed on Dec. 29, 2000, now U.S. Pat. No. 6,379,263, which is a continuation application of U.S. patent application Ser. No. 09/330,292, filed on Jun. 12, 1999, now U.S. Pat. No. 6,210,290.

FEDERAL RESEARCH STATEMENT

[Federal Research Statement Paragraph]

BACKGROUND OF THE INVENTION

1. Field of the Invention

The present invention relates to golf clubs and, more specifically golf club heads with additional weighting to provide better performance, greater weighting flexibility and lower production costs.

2. Description of the Related Art

The location and distribution of weight within a golf club is an important factor in the performance of the golf club. In particular, weight placement at the bottom of the golf club head provides a low center of gravity to help propel a golf ball into the air during impact, and weight concentrated at the toe and heel of the golf club head provides a resistance to twisting, or high moment of inertia, during golf ball impact. Both the low center of gravity and high moment of inertia are important performance variables which affect playability and feel of the golf club. Alternative designs have resulted in many innovations for varying the weight location and distribution in a golf club head portion. Among these designs is a combination of high and low density materials within the golf club head, and associated methods for combining these materials.

One example of multiple materials used in the construction of the golf club head is a high density material attached to a lower density material golf club head. A high density block or contoured shape is attached, via mechanical means such as friction fit, fasteners or screws, to a reciprocal recess in the golf club head, as shown in U.S. Pat. No. 5,776,010, issued to Helmstetter et al. Although supplying the desired performance enhancements, the high density block and the reciprocal recess must be machined to precise tolerances, involving high production costs.

Another example of weighting the golf club is pouring a high density fluid into a reservoir within the golf club. This ensures an exact placement of the weighting material within the golf club, as the fluid will conform to the internal shape of the reservoir without the need for mechanical or an adhesive bonding. One drawback of this type of processing is the requirement that one must operate below the melt or softening temperature of the club head material. In addition, as processing temperatures increase the associated costs will increase to accommodate higher energy use and high temperature equipment. The limitations for a low melt temperature, yet high density, material restricts the available options for this type of process.

To overcome the limitations associated with a single material, the advent of multi-component weighting systems makes use of the high density materials in combination with a carrier fluid, such as a polymer. A particulate form of the high density material is mixed with the carrier fluid and poured into the reservoir in the golf club, wherein the carrier fluid is allowed to solidify to form a composite weighting material. Readily available materials include a thermoset polymer carrier fluid, such as epoxy, which allows ambient temperature processing and solidification of the high density material and epoxy mixture. A thermoplastic polymer carrier fluid, such as polypropylene, requires heat to obtain a fluid state and cools to a solid at ambient temperatures, with the capability to be re-heated to the fluid state, in distinction to the epoxy. A disadvantage of the multi-component weighting system is the low density associated with the carrier fluid, typically 1 g/cm$^3$, thus requiring a high ratio of the weighting material to the carrier fluid to obtain the desired high density for a bi-material weight. The carrier fluid also acts as a binder for the weighting material to ensure the bi-material weight forms a solid block.

A drawback to the multi-component weighting system is the need to use small amounts of carrier fluid relative to the weighting material, leading to entrapped air or voids and incomplete binding in the bi-material weight. Incorporating larger amounts of the carrier fluid promotes better mixing within the bi-material weight in conjunction with an attendant decrease in density. Therefore, it is desirable to provide a bi-material weight containing a higher density carrier fluid to provide greater weighting flexibility for allocating weight within a golf club head in conjunction with lower cost production. It is further desirable to provide a golf club head to accommodate the bi-material weight and enable a variable location of the bi-material weight.

SUMMARY OF THE INVENTION

The present invention further increases the playability of irons for all types of golfers by lowering the center of gravity of the golf club head while creating a forgiving hitting area. The present invention is able to accomplish this by use of a front wall that has variable thickness and a weighting means that lowers the center of gravity of the golf club head.

DETAILED DESCRIPTION

Figure 1:
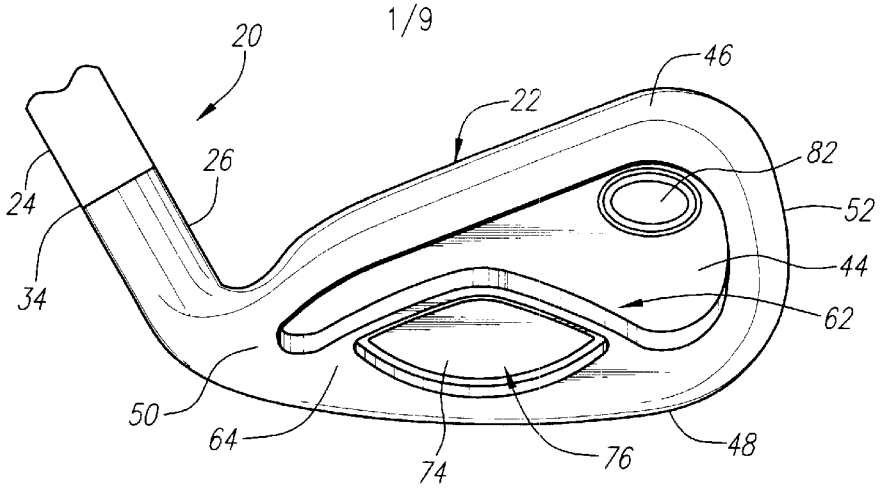
FIG. 1 is a rear view of a golf club head of the present invention.
Figure 2:
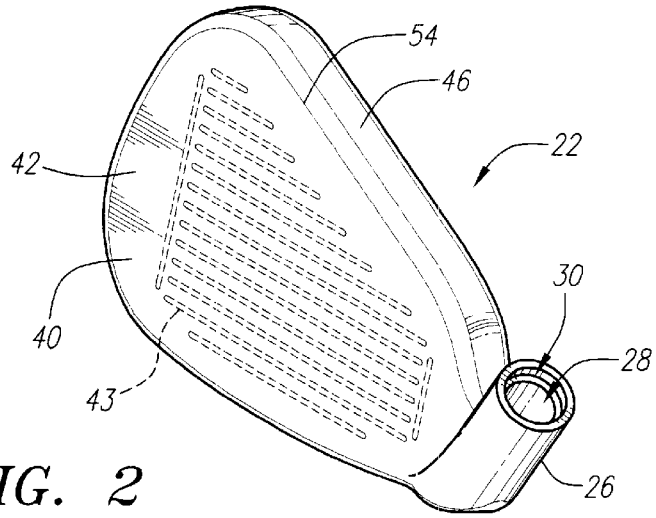
FIG. 2 is a front perspective view of the golf club head of the present invention.
Figure 3:
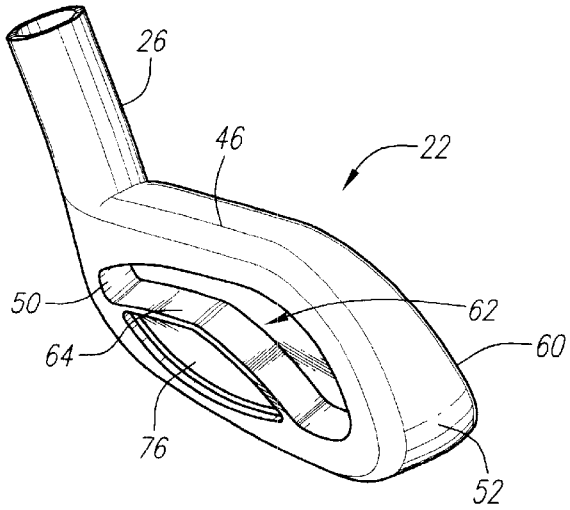
FIG. 3 is a rear perspective view of the golf club head of the present invention.

As shown in FIGS. 1–8 a golf club of the present invention is generally designated 20. The golf club has a golf club head 22 and a shaft 24. The shaft 24 is attached to a hosel 26 of the golf club head 22. The hosel 26 has a bore 28 with an ingress opening 30 and optionally an egress opening 32. A tip end 34 of the shaft 24 is inserted into the bore 28. In a preferred embodiment the golf club head 22 is composed of a titanium alloy, however, those skilled in the relevant art will recognize that other materials such as stainless steel, carbon steel, and the like may be utilized without departing from the scope and spirit of the present invention.

The golf club head 22 has a front wall 40 with a face surface 42 and a rear surface 44. The face surface 42 preferably has a plurality of scorelines 43 thereon, and face surface 42 contacts a golf ball during a golfer's swing. In a preferred embodiment, the top of the hosel 26 is lower than the toe end of the front wall 40 allowing for more weight to be redistributed from the hosel 26 thereby lowering the center of gravity of the golf club head 22. The golf club head also has a top wall 46, a bottom wall 48, a heel wall 50 and a toe wall 52. The top wall 46 extends rearward from a top end 54 of the front wall 40, in a direction opposite the face surface 42. The bottom wall 48 extends rearward from a bottom end 56 of the front wall 40, in a direction opposite the face surface 42. The heel wall 50 extends rearward from a heel end 58 of the front wall 40, in a direction opposite the face surface 42. The toe wall 52 extends rearward from a toe end 60 of the front wall 40, in a direction opposite the face surface 42. The rear surface 44, the top wall 46, the bottom wall 48, the heel wall 50 and the toe wall 52 define an external rear cavity 62 of the golf club head 22. The top wall 46, the bottom wall 48, the heel wall 50 and the toe wall 52 also provide the golf club head 22 with perimeter weighting to make the golf club 20 more forgiving for better performance for the typical golfer.

An aft wall 64 extends upward from an aft end 66 of the bottom wall 48 to partially cover the external rear cavity 62. The aft wall 64 has an apex 67 near its center and gradually declines in height toward the heel wall 50 and the toe wall 52. In a preferred embodiment, the aft wall 64 has a pseudo-triangular shape.

Figure 1A:
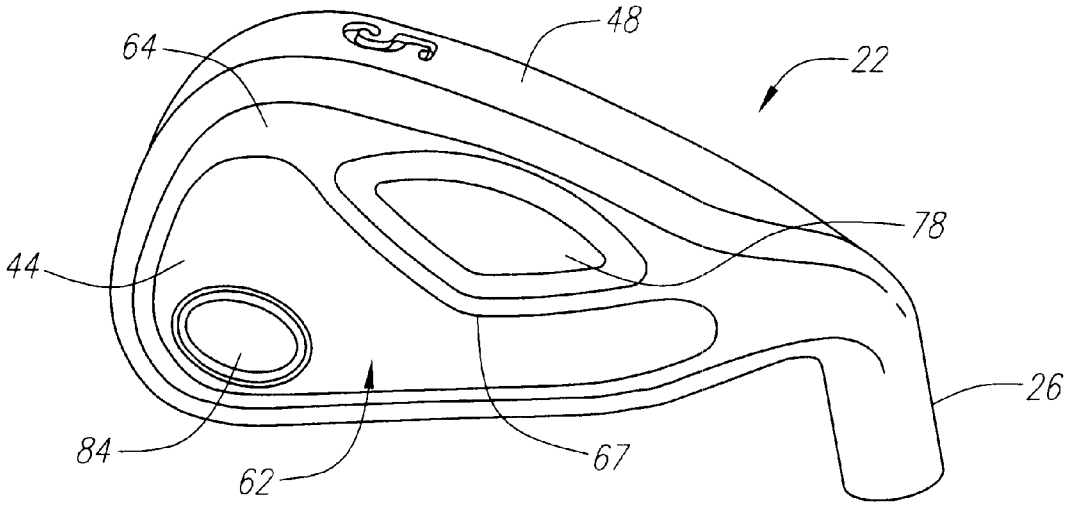
FIG. 1A is rear view of a golf club head of the present invention with a medallion.
Figure 1B:
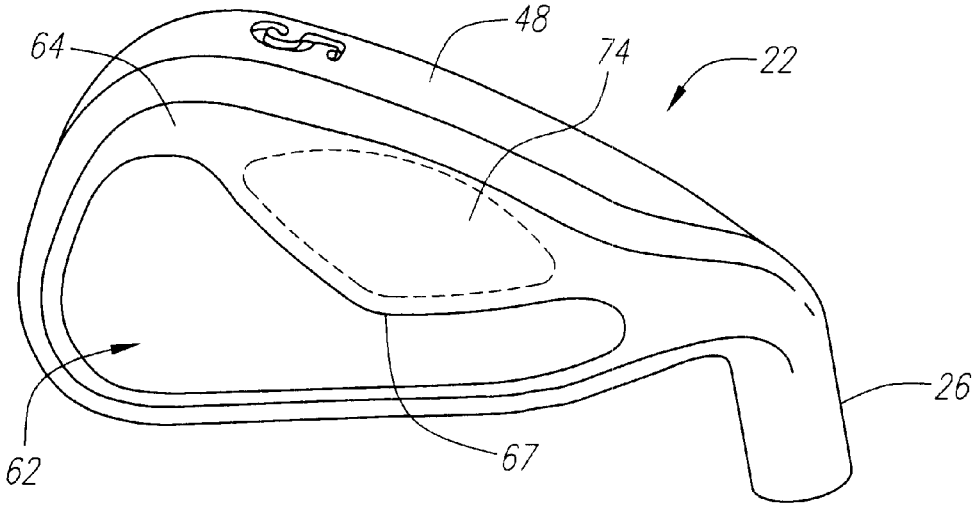
FIG. 1B is a rear view of an alternative embodiment of the golf club head of the present invention.
Figure 4:
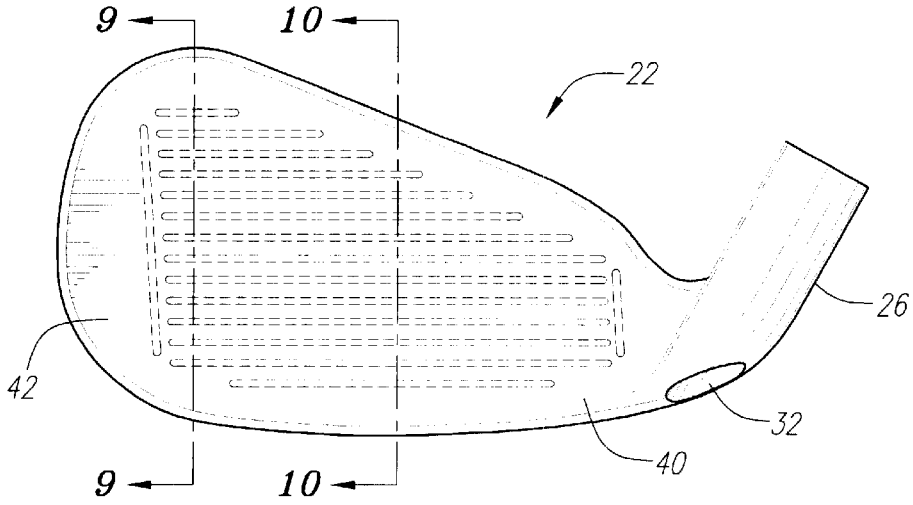
FIG. 4 is a front view of the golf club head of the present invention.
Figure 5:
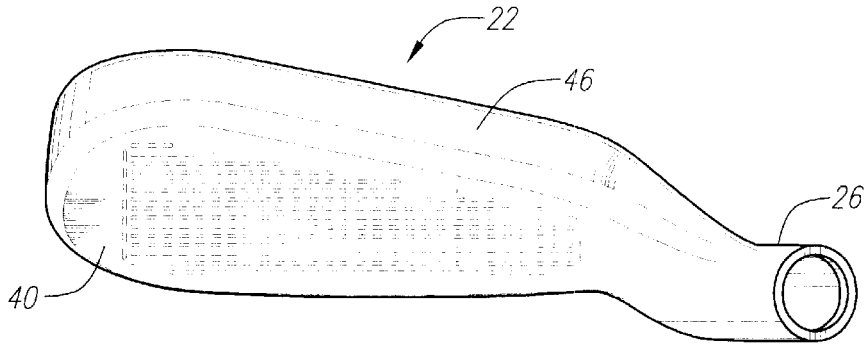
FIG. 5 is a top view of the golf club head of the present invention.
Figure 6:
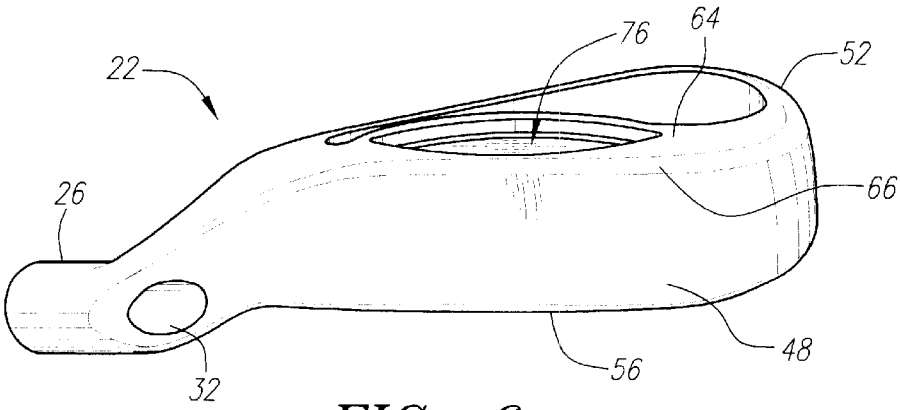
FIG. 6 is a bottom view of the golf club head of the present invention.
Figure 7:
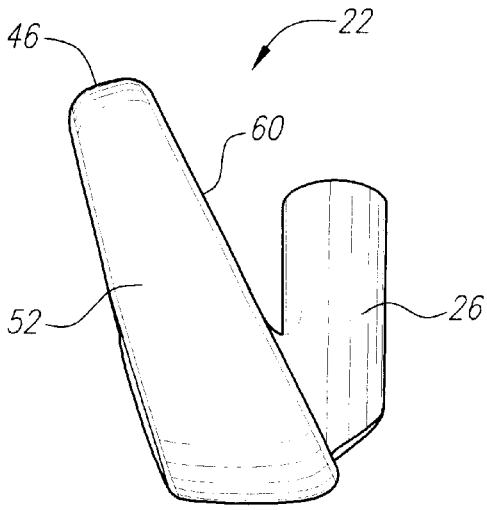
FIG. 7 is a toe view of the golf club head of the present invention.
Figure 8:
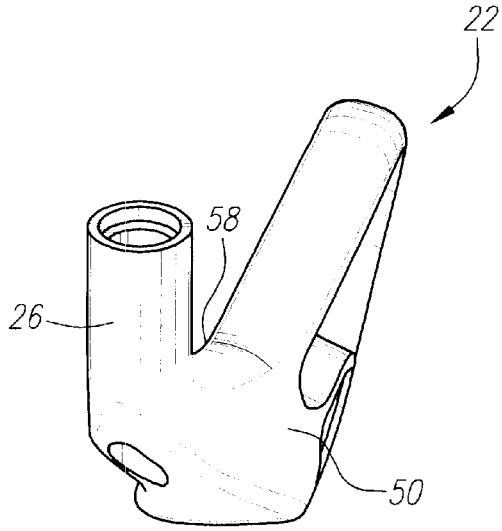
FIG. 8 is a heel view of the golf club head of the present invention.
Figure 9:
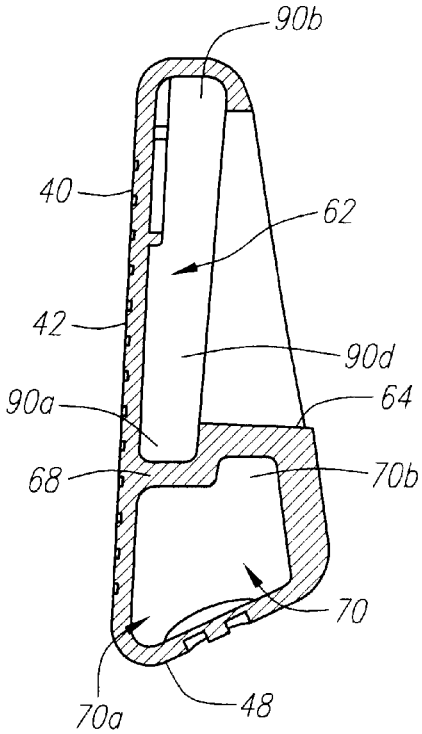
FIG. 9 is a cut-away view along line 9—9 of FIG. 4.
Figure 10:
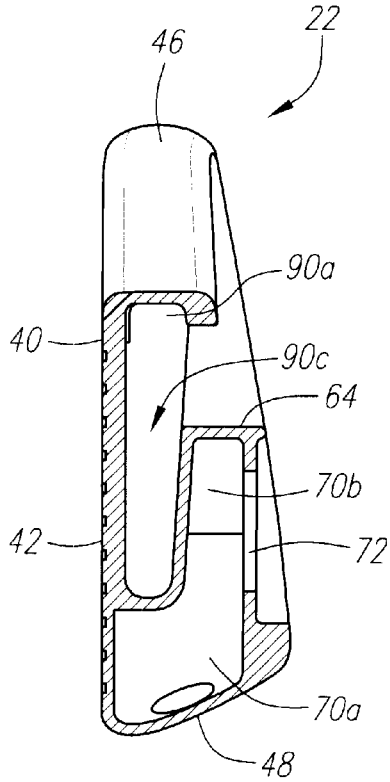
FIG. 10 is a cut-away view along line 10—10 of FIG. 4.

An internal cavity 70 of the golf club head 22 is accessed through an opening 72 in the aft wall 64. The opening 72 is defined by a recess 76 in the aft wall 64 into which a plate 74 is optionally placed over the opening 72. A medallion 78 is preferably placed within the recess 76 for swing weighting purposes, as shown in FIG. 1A. Alternatively, the opening 72 is covered with a plate 74 and polished over as illustrated in FIG. 1B. The internal cavity 70 is defined by the aft wall 64, a ceiling wall 68, a portion of the bottom wall 48, a portion of the front wall 40, a portion of the heel wall 50 and a portion of the toe wall 52. The internal cavity 70 preferably has a main chamber 70*a* that extends from the heel wall 50 to the toe wall 52 and a minor chamber that is within the aft wall 64. The main chamber 70*a* and the minor chamber 70*b* are in flow communication with each other.

The internal cavity 70 preferably has a volume from 5 $cm^3$ to 25 $cm^3$, and in a most preferred embodiment from 9 $cm^3$ to 15 $cm^3$. The length and volume of the internal cavity allow for flexibility in the placement of a weighting member 80 therein to control the location of the center of gravity in order to improve the feel during impact of the golf club head 22 with a golf ball.

In a preferred embodiment, a medallion recess area 82 is disposed on the rear surface 44 of the front wall 40. A medallion 84 is preferably disposed within the recess area 82, and more preferably a holographic medallion 84 is disposed within the recess area 82.

In a preferred embodiment, the golf club head 22 has an undercut recess 90 in communication with the external rear cavity 62. In a preferred embodiment, a bottom wall undercut recess 90*a* is within the bottom wall 48, a top wall undercut recess 90*b* is within the top wall 46, a heel wall undercut recess 90*c* is within the heel wall 50 and a toe wall undercut recess 90*d* is within the toe wall 52. Alternatively, the golf club head 22 has only one of one the undercut recess 90*a*, 90*b*, 90*c* and 90*d*. In yet another alternative embodiment, the golf club head 22 has only two of the undercut recesses 90*a*, 90*b*, 90*c* and 90*d*. In still yet another alternative embodiment, the golf club head 22 has only three of the undercut recesses 90*a*, 90*b*, 90*c* and 90*d*. Such an undercut recess 90 is disclosed in greater detail in U.S. Pat. No. 5,409,229, for a Golf Head With Audible Vibration Attenuation, which is hereby incorporated by reference in its entirety.

Figure 11:
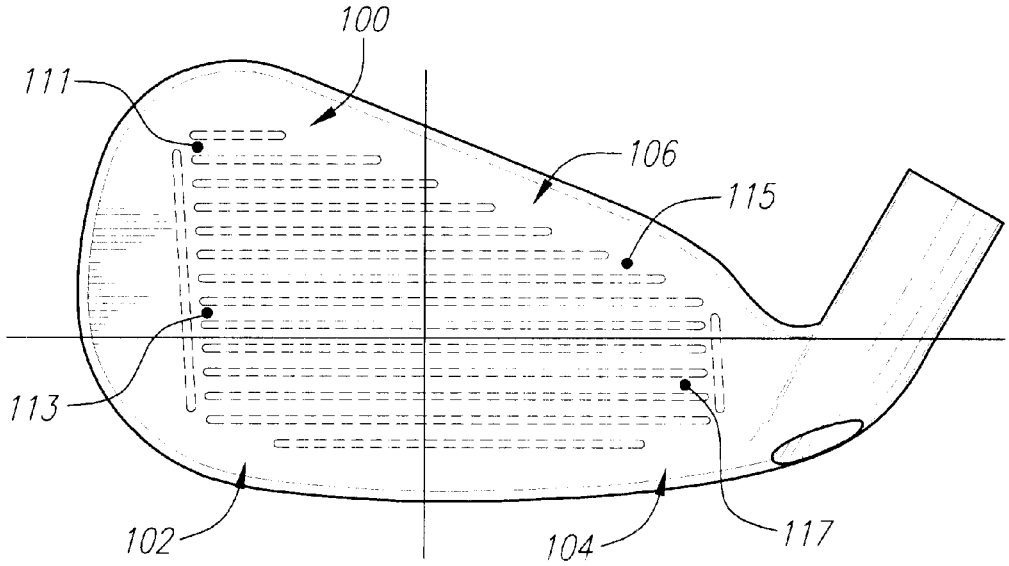
FIG. 11 is a front view of the golf club head of the present invention with the front wall partitioned into quadrants to demonstrate the variable face thickness aspect of the present invention.

In a preferred embodiment, the front wall 40 has a variable thickness that ranges from 0.060 inch to 1.90 inch. The variable thickness allows for less weight in the front wall allowing for the center of gravity to be lowered in the golf club head 22 through use of the weighting member 80. As shown in FIG. 11, the front wall 40 is partitioned into an upper toe quadrant 100, a lower toe quadrant 102, a lower heel quadrant 104 and an upper heel quadrant 106. The upper toe quadrant 100 is the thinnest quadrant of the front wall 40 preferably ranging in thickness from 0.060 inch to 0.105 inch. The upper heel quadrant 106 is the thickest preferably ranging from 0.120 inch to 0.190 inch. In a preferred embodiment, point 111 has a thickness ranging from 0.060 inch to 0.105 inch, more preferably ranging from 0.068 inch to 0.098 inch, even more preferably ranging from 0.070 inch to 0.082 inch, and is most preferably 0.073 inch. In a preferred embodiment, point 113 has a thickness ranging from 0.070 inch to 0.125 inch, more preferably ranging from 0.075 inch to 0.120 inch, even more preferably ranging from 0.083 inch to 0.095 inch, and is most preferably 0.089 inch. In a preferred embodiment, point 115 has a thickness ranging from 0.100 inch to 0.170 inch, more preferably ranging from 0.125 inch to 0.165 inch, and is most preferably 0.138 inch. In a preferred embodiment, point 117 has a thickness ranging from 0.125 inch to 0.200 inch, more preferably ranging from 0.150 inch to 0.190 inch, and is most preferably 0.169 inch. A more detailed description of the variable face thickness is disclosed in U.S. Pat. No. 5,971,868, for a Contoured Back Surface Of Golf Club Face, which is hereby incorporated by reference in its entirety.

Figure 12:
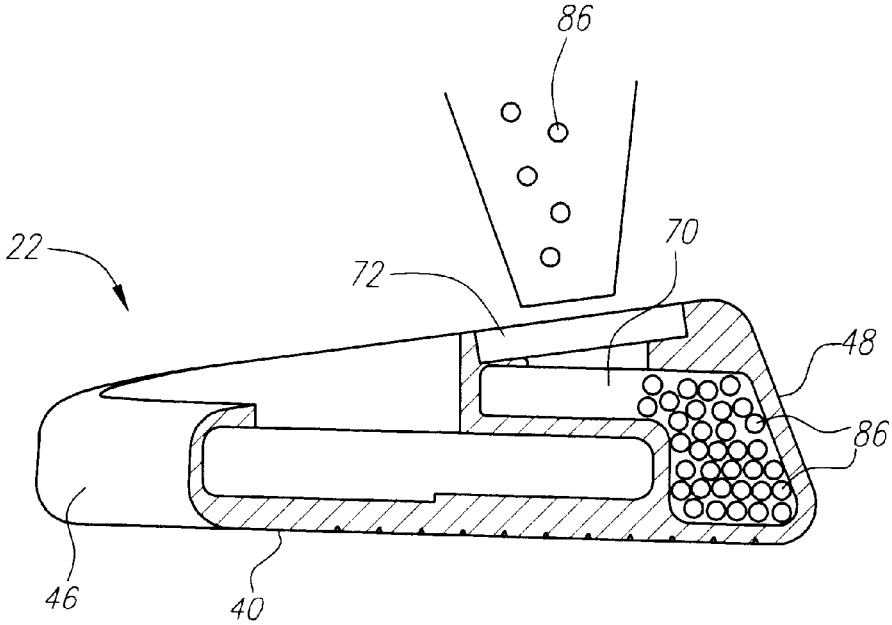
FIG. 12 is a cut-away view of the golf club head and the first weight material of an embodiment of the present invention.

A preferred method for adding weight material to the golf club head 22 involves a bi-material weighting operation. FIG. 12 is a cut-away view of the golf club head 22 of a method embodiment of the present invention. The golf club head 22 is weighed and a predetermined, or specific, weight of a first weight material 86 is added to the internal cavity 70. In a preferred embodiment the first weight material 86 occupies 10% to 40% of the internal cavity 70. In a more preferred embodiment the first weight material 86 is a metal material that exhibits a high density, good compatibility with structural metals such as titanium and steel, high environmental stability and good commercial availability. Available choices for the first weight material 86 are copper metals, brass metals, steel and tungsten metals. In a preferred embodiment the density of the first weight material 86 is greater than 12 g/cm$^3$, more preferred is between 12 g/cm$^3$ and 20 g/cm$^3$. In a most preferred embodiment, the first weight material 86 comprises tungsten alloy spheres, with approximately 18 g/cm$^3$ density and having a diameter greater than 3 mm, dispensed into the internal cavity 70 of the golf club head 22. The requirement for a diameter in excess of 3 mm is to provide an effective fluid path between the spheres and ensure a fully dense weight block.

Figure 14:
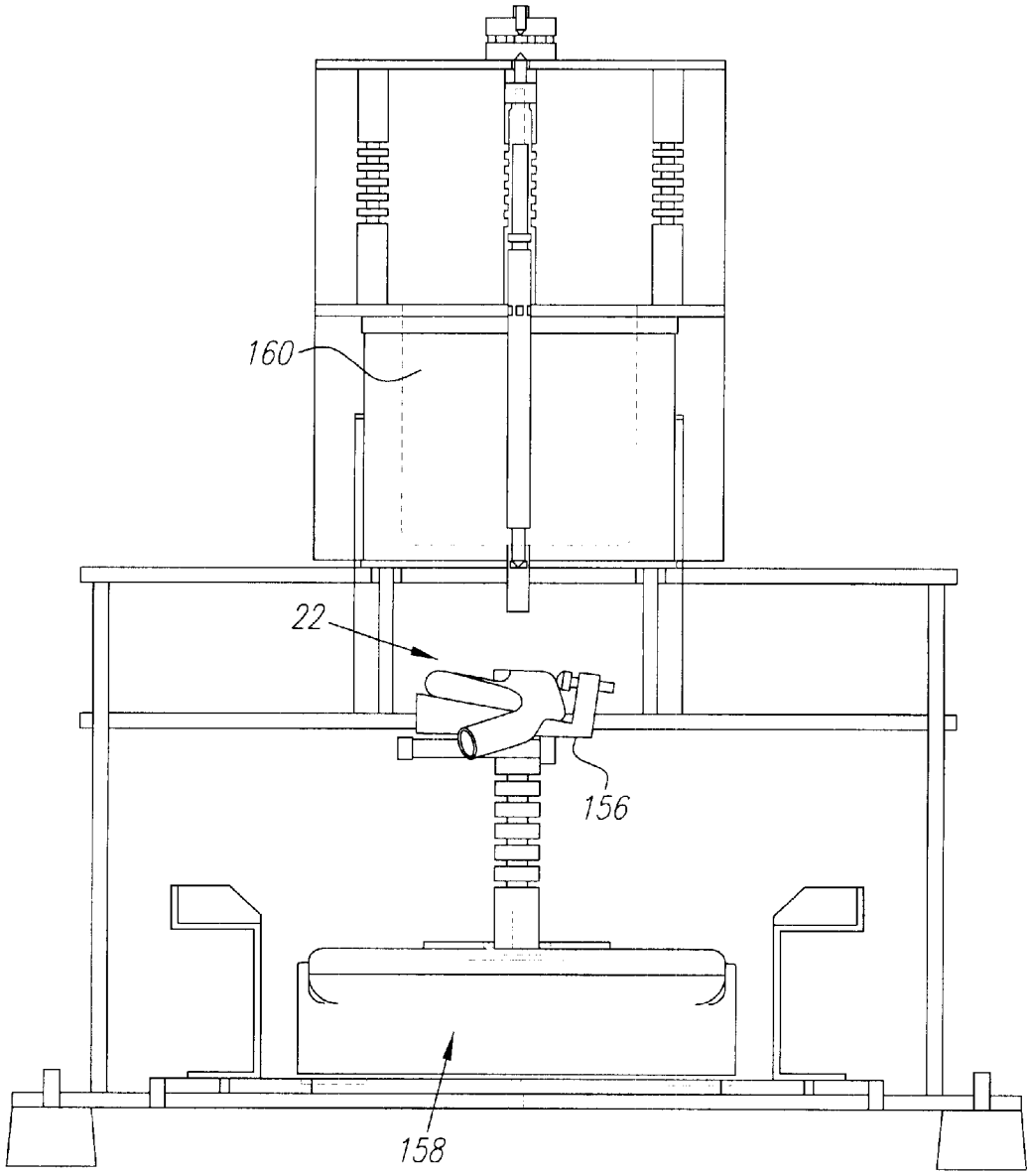
FIG. 14 is a heel view of the golf club head during addition of the second weight material of an embodiment of the present invention.

In manufacturing the golf club head 22, the golf club head 22 and the first weight material 86 are raised to a temperature sufficient to maintain a second weight material 88 (as shown in FIG. 14) in a fluid or liquid phase. In a preferred embodiment, a continuous oven is used to raise the temperature of the golf club head 22 and the first weight material 86 to at least 350° F. Although several heating methods are available, in a preferred operation, the golf club head 22, containing tungsten alloy spheres as the first weight material 86, is placed upon a heated conveyor moving at 5.5 inches/minute through a 24 inch heat zone.

Figure 13:
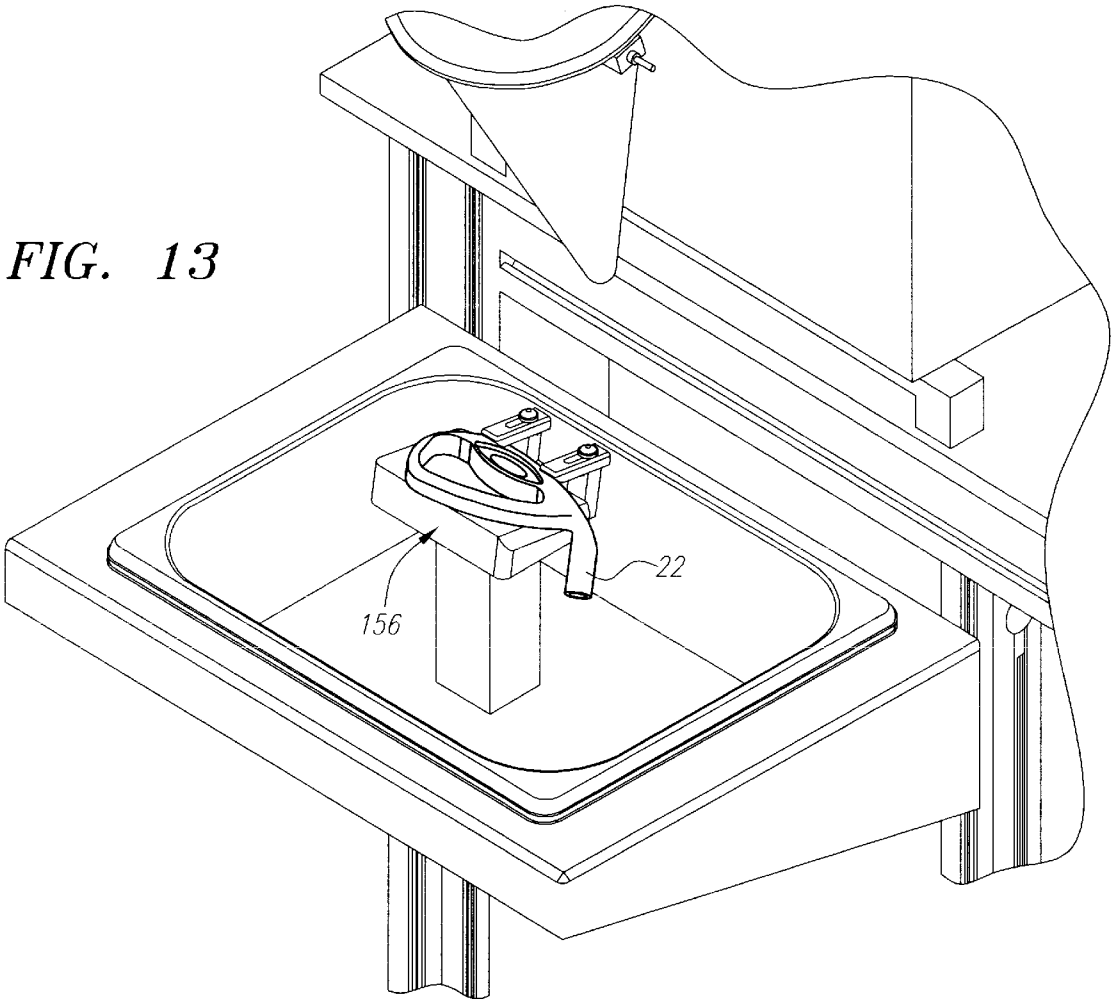
FIG. 13 is a top perspective view of the golf club head within a fixture of an embodiment of the present invention.

After exiting the heating operation the golf club head 22 containing the tungsten alloy spheres is secured in a fixture 156, as shown in FIG. 13. The second weight material 88 is dispensed into the internal cavity 70 of the golf club head 22, as shown in FIG. 14. In a preferred embodiment the density of the second weight material 88 is less than 14 g/cm$^3$, more preferred is between 6 g/cm$^3$ and 10 g/cm$^3$. In a most preferred embodiment, the second weight material 88 is a bismuth-tin solder, with approximately 8.6 g/cm$^3$ density, heated to a liquid phase of at least 350° F. The weighting method may include any number of combinations associated with heating the golf club head 22 and the first and second weight materials 86 and 88 to form a finished product. Attached to the fixture 156 is a scale 158 to measure the total weight of the golf club head 22 during addition of the second weight material 88. In a preferred embodiment, the scale 158 is used throughout the weighting method to ensure that the proper amount of the first and the second weight material 86 and 88 have been added to the golf club head 22.

Figure 15:
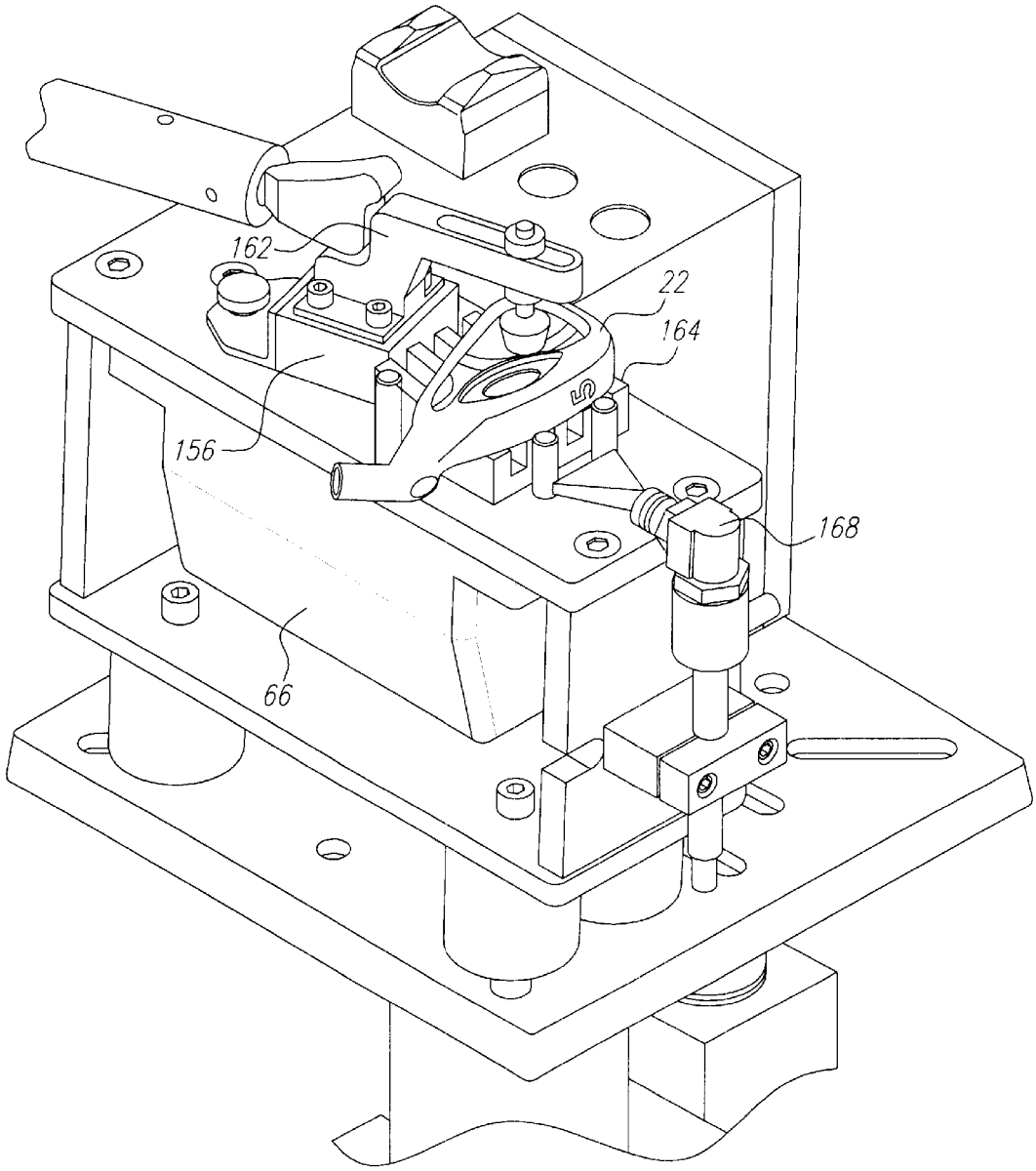
FIG. 15 is a top perspective view for clamping the golf club head of an embodiment of the present invention.
Figures 16, 17:
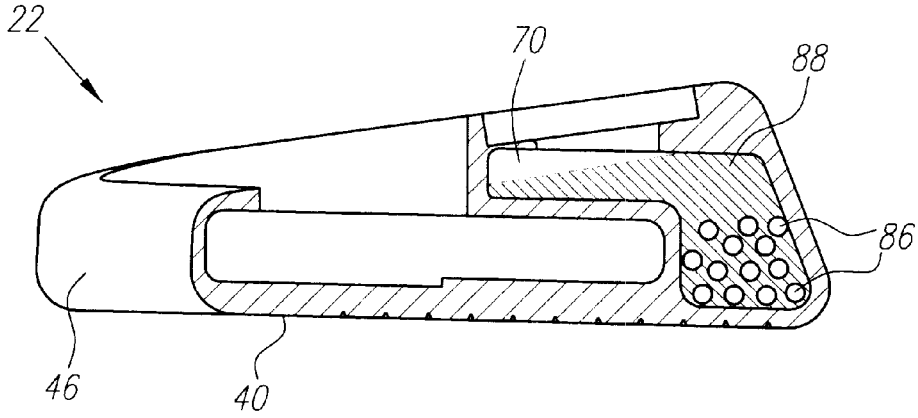
FIG. 16 is a cut-away view of the golf club head containing the bi-material weight of an embodiment of the present invention.
FIG. 17 is a table of the mass without weighting, the volume of the internal cavity and the mass with weighting for golf club heads of a preferred embodiment of the present invention.

The golf club head 22 is forced against the fixture 156 and a mounting pad 164 via a clamp 162, as shown in FIG. 15. The mounting pad 164 is used to tilt the golf club head 22 to any desired orientation allowing the first weight material 86 to migrate to the lowest point in the internal cavity 70 under the influence of vibrational energy. Vibrational energy treatment of the golf club 22 and a bi-material weight 80 (as shown in FIG. 16) may be accomplished by a mechanical device, ultrasound, radiation, or any other means of imparting vibrational energy. In a preferred embodiment, a mechanical vibration device supplies a small amplitude vibration to the golf club head 22. The timing for starting and stopping the vibration is an important factor in obtaining the benefits of the present invention. The second weight material 88 should be in a liquid phase while exposed to vibration energy to prevent the first weight material 86 from creating voids or migrating out of the second weight material 88. In a preferred embodiment, the vibrational energy is sustained for approximately twenty seconds. Following termination of the vibrational treatment, the golf club head 22 is cooled to allow the second weight material 88 to solidify. Cooling of the bi-material weight 80 may be accomplished by refrigeration, immersion in a cold fluid such as water, or simply allowing the golf club head 22 to cool naturally to ambient temperature. In a preferred embodiment, an air nozzle 168 supplies cooling air to the golf club head 22.

FIG. 16 shows the golf club head 22 containing the bi-material weight 80 comprising the first weight material 86 and the second weight material 88. The golf club head 22 may have a range of initial weights reflecting variability in manufacturing the golf club head 22. In FIG. 17, preferred specifications for irons 1–9 along with pitching wedge, approach wedge, sand wedge and lob wedge for the golf club head 22 of the present invention are listed with the mass of the golf club head 22 (in grams) without weighting in column 2, the volume of the internal cavity 70 (in cubic centimeters) in column 3, and the golf club head 22 with the weighting (in grams) in column 4.

It is understood that various modifications can be made to the golf club head 22 and method of weighting, both outlined above, and remain within the scope of the present invention. For example, the golf club head 22 can be a wood-type golf club, a putter or an iron-type golf club, and can be made from various materials including metals and non-metals.

We claim:

1. An iron-type golf club head comprising:

a front wall having a face surface and a rear surface;

a top wall extending rearward from a top end of the front wall;

a bottom wall extending rearward from a bottom end of the front wall;

a heel wall extending rearward from a heel end of the front wall;

a toe wall extending rearward from a toe end of the front wall;

an external rear cavity defined by the rear surface of the front wall, the top wall, the bottom wall, the heel wall and the toe wall;

an aft wall extending upward from an aft end of the bottom wall, the aft wall covering a portion of the external cavity;

an internal cavity within the aft wall;

a weighting member within the internal cavity;

wherein the front wall has a thickness that varies from 0.060 inch to 0.190 inch with the upper toe quadrant of the front wall the thinnest portion of the front wall.

2. The iron-type golf club head according to claim 1 wherein the internal cavity is defined by a portion of the front wall, a portion of the bottom wall, a portion of the aft wall and a ceiling wall.

3. The iron-type golf club head according to claim 1 wherein the weighting member is a bi-metal material comprising tungsten alloy spheres and a bismuth-tin solder.

4. The iron-type golf club head according to claim 1 further comprising an undercut recess located within one of the bottom wall, top wall, heel wall and toe wall.

5. The iron-type golf club head according to claim 1 further comprising an undercut recess located within two of the bottom wall, top wall, heel wall and toe wall.

6. The iron-type golf club head according to claim 1 further comprising an undercut recess located within each of the bottom, wall, top wall, heel wall and toe wall.

7. The iron-type golf club head according to claim 1 further comprising a medallion disposed on the rear surface of the front wall.

8. The iron-type golf club head according to claim 1 wherein the aft wall has an apex and descends in height from the apex toward the heel wall and the toe wall.

9. The iron-type golf club head according to claim 1 further comprising a hosel, the top of the hosel being lower than a toe end of the front wall when in address position.

10. A golf club comprising:

a front wall having a face surface and a rear surface, a top wall extending rearward from a top end of the front wall, a bottom wall extending rearward from a bottom end of the front wall, a heel wall extending rearward from a heel end of the front wall, a toe wall extending rearward from a toe end of the front wall, an external rear cavity defined by the rear surface of the front wall, the top wall, the bottom wall, the heel wall and the toe wall, a weighting member within the golf club head, and a hosel having a bore therein, the top of the hosel being lower than a toe end of the front wall when the golf club is in the address position, wherein the front wall has a thickness that varies from 0.060 inch to 0.190 inch with the upper toe quadrant of the front wall the thinnest portion of the front wall; and a shaft having a tip end disposed within the bore of the hosel.

11. An iron-type golf club head comprising: a front wall having a face surface and a rear surface; a top wall extending rearward from a top end of the front wall; a bottom wall extending rearward from a bottom end of the front wall; a heel wall extending rearward from a heel end of the front wall; a toe wall extending rearward from a toe end of the front wall; an external rear cavity defined by the rear surface of the front wall, the top wall, the bottom wall, the heel wall and the toe wall; an aft wall extending upward from an aft end of the bottom wall, the aft wall covering a portion of the external cavity; an internal cavity within the aft wall; a bi-metal weighting material comprising tungsten alloy spheres and a bismuth-tin solder, the bi-metal weighting material within the internal cavity; wherein the front wall has a thickness that varies from 0.060 inch to 0.190 inch with the upper toe quadrant of the front wall the thinnest portion of the front wall.

* * * * *